US008390526B1

(12) United States Patent
O'Connell et al.

(10) Patent No.: US 8,390,526 B1
(45) Date of Patent: Mar. 5, 2013

(54) WIDE SCAN PHASED ARRAY ANTENNA ELEMENT

(75) Inventors: John B. O'Connell, Seattle, WA (US); Bruce L. Blaser, Auburn, WA (US)

(73) Assignee: The Boeing Company, Chicago, IL (US)

( * ) Notice: Subject to any disclaimer, the term of this patent is extended or adjusted under 35 U.S.C. 154(b) by 149 days.

(21) Appl. No.: 12/873,831

(22) Filed: Sep. 1, 2010

(51) Int. Cl.
*H01Q 9/04* (2006.01)

(52) U.S. Cl. ..... 343/791; 343/790; 343/792; 343/793

(58) Field of Classification Search ..... 343/790, 343/791, 792, 830, 793
See application file for complete search history.

(56) References Cited

U.S. PATENT DOCUMENTS 5,886,671 A 3/1999 Riemer et al.
6,078,295 A * 6/2000 Rawle ..... 343/730
6,320,555 B1 * 11/2001 Schadler ..... 343/791
6,963,313 B2 * 11/2005 Du ..... 343/790
2006/0055615 A1 * 3/2006 Zhou ..... 343/790
2007/0205959 A1 * 9/2007 Nakaya et al. ..... 343/876

* cited by examiner

*Primary Examiner* — Dieu H Duong
(74) *Attorney, Agent, or Firm* — Toler Law Group

(57) ABSTRACT

Antenna elements operable to radiate different patterns are provided. A particular apparatus includes a first antenna element having a plurality of radiating elements. Each of the radiating elements includes a first member having a first end and a second end. The first end is coupled to an antenna interface and the second end extends a length of the first member from the first end. Each of the radiating elements further includes a second member having a third end and a fourth end. The third end is electrically coupled to the first member at a point partway along the length of the first member. The fourth end extends away from the first member. When a first radiating element is radiating in the presence of a second radiating element, a null is generated in a radiation pattern of the first radiating element.

20 Claims, 10 Drawing Sheets

WIDE SCAN PHASED ARRAY ANTENNA ELEMENT

FIELD OF THE DISCLOSURE

The present disclosure is generally related to antenna elements that are adapted to radiate signals in a wide pattern.

BACKGROUND

Selection of an antenna to use for a mobile platform, such as an aircraft, may involve tradeoffs between countervailing considerations. For example, there may be a tradeoff between various transmission or reception concerns and other countervailing considerations, such as aerodynamic profile. To illustrate, a conventional phased array antenna may have a limited scan angle, e.g. up to an angle of about 65° from a vertical axis toward a horizon. However, phased array antennas provide a small aerodynamic profile that result in little or no additional drag on the mobile platform. In contrast, a dish antenna may provide a wider scanning pattern, but may incur a significant aerodynamic profile penalty that results in higher drag on the mobile platform. Other tradeoffs may be considered with other types of antennas. For example, continuous transverse stub array antennas may provide a wide scanning range with a relatively small aerodynamic profile. However, continuous transverse stub array antennas tend to scan at relatively low speeds, which may not be suitable for applications where high scanning speed is desired.

In addition, different communications applications executing on the mobile platform may benefit from different antenna profile types. However, providing multiple antennas may add complexity, cost, bulk, weight, or some combination of these undesirable attributes to the mobile platform.

SUMMARY

Embodiments disclosed herein include antenna elements that are operable to radiate signals in desired patterns over a wide area. When an antenna element is mounted relative to a surface, the antenna element is operable to radiate a signal through a range extending from a first direction perpendicular to the surface through a second direction parallel with the surface. The antenna element includes a plurality of radiating elements. A radiating element may include two connected conductive members that may be disposed within a non-conductive member. In the presence of other radiating members, the radiating element generates a radiation pattern that includes a null. The position of the null can be controlled. For example, by controlling phases of a supplying signal to two or more radiating elements, the location of the null of each of the radiating elements can be adjusted. Thus, the antenna element may radiate in a pattern similar to an open-ended waveguide, in a patter similar to a dipole antenna, or as another type of antenna.

In a particular embodiment, an apparatus includes a first antenna element having a plurality of radiating elements. Each of the plurality of radiating elements includes a first elongated member having a first end and a second end. The first end is coupled to an antenna interface and the second end extends a length of the first elongated member from the first end. A second elongated member has a third end and a fourth end. The third end is electrically coupled to the first elongated member at a point partway along the length of the first elongated member. The fourth end extends away from the first elongated member. When a first radiating element of the plurality of radiating elements is radiating in the presence of a second radiating element of the plurality of radiating elements, a null is generated in a radiation pattern of the first radiating element.

In another particular embodiment, an apparatus includes an antenna element that includes a non-conductive body and a plurality of radiating elements supported within the non-conductive body. Each of the plurality of radiating elements includes a first conductor extending to a conductor end at a distance of approximately $\lambda/2$ above an antenna interface, where $\lambda$ is the wavelength of a signal intended to be transmitted via the antenna element. Each of the plurality of radiating elements also includes a second conductor electrically coupled to the first conductor at a distance of approximately $\lambda/4$ above the antenna interface. The second conductor extends substantially transversely from the first conductor. The plurality of radiating elements is arranged such that the second conductor of each of the plurality of radiating elements extends generally toward an adjacent radiating element.

In still another embodiment, a method includes receiving a signal at each of a plurality of radiating elements of an antenna element. Each of the radiating elements includes a first conductor having a first end and a second end. The first end is coupled to an antenna interface. The second end extends a length of the first conductor from the first end. A second conductor has a third end and a fourth end. The third end is electrically coupled to the first conductor at a point partway along the length of the first conductor. The fourth end extends away from the first conductor. The method also includes propagating the signal via the plurality of radiating elements. The signal is propagated in a first mode when the signal received by each of the plurality of radiating elements is at a same magnitude and in a common phase. The signal is propagated in a second mode when the signal received by each of the plurality of radiating elements is in the same magnitude and at a shifted phase with respect to an adjacent radiating element.

The features, functions, and advantages that are described can be achieved independently in various embodiments or may be combined in yet other embodiments, further details of which are disclosed with reference to the following description and drawings.

DETAILED DESCRIPTION

According to an illustrative embodiment, an antenna element is provided that may be used in a phased array to radiate signals in desired patterns over a wide area. The antenna element may be mounted over a surface and configured to radiate a signal through a range extending from a first direction perpendicular to the surface through a second direction parallel with the surface. The antenna element includes a plurality of radiating elements. When radiating in the presence of one or more other radiating members, each of the radiating elements generates a radiation pattern having a null. The null generated by each radiating member may be controlled to adjust a radiation pattern of the antenna element or of a phased array antenna that includes the antenna element. For example, by controlling a relative phase of a signal supplied to each of the radiating elements, the radiation pattern generated by the antenna element may be varied from a radiation pattern similar to an open-ended waveguide to a radiation pattern similar to a dipole antenna.

Figure 1:
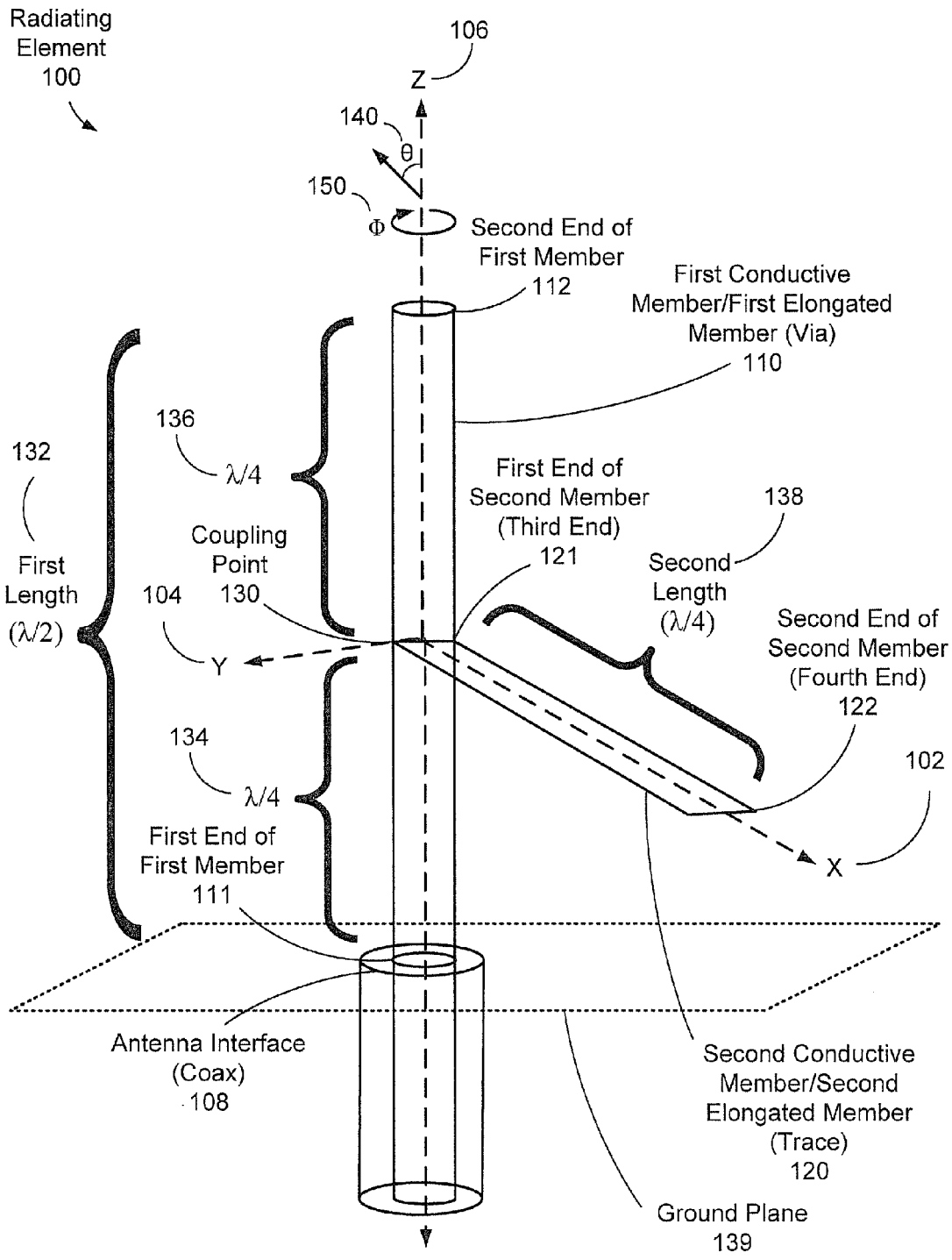
FIG. 1 is a perspective diagram of a particular embodiment of a radiating element.

FIG. 1 is a perspective diagram of a particular embodiment of a radiating element 100. The radiating element 100 may be used with other radiating elements to form an antenna element. The radiating element 100 may include a first conductive member 110 (also referred to herein as a "first elongated member" or simply a "first member") and a second conductive member 120 (also referred to herein as a "second elongated member" or simply a "second member"). The first member 110 has a first end 111 and a second end 112 separated by a first length 132 of the first member 110. In a particular illustrative embodiment, the first length 132 is approximately $\lambda/2$, where $\lambda$ is a wavelength of a signal intended to be transmitted or received by the radiating element 100 (e.g., $\lambda$ may be a design wavelength). The first end 111 of the first member 110 may be coupled to an antenna interface 108, which may include a coax (i.e., coaxial cable). The antenna coupler or coax 108 is positioned with an opening at a ground plane 139. A coax shield (not shown in FIG. 1) is attached to the ground plane 139 and a coax center pin (not shown in FIG. 1) is attached to the first member 110. The second end 112 of the first member 110 extends along a z-axis 106, which is orthogonal an x-axis 102 and a y-axis 104. In a particular embodiment, the second end 112 may be a free end (e.g., not coupled to another conductor or radiating element).

The second member 120 has a first end (designated as a third end 121 for eased of differentiation from the first end 111 of the first member 110) and a second end (designated as a fourth end 122 for eased of differentiation from the second end 112 of the first member 110). The second member 120 may be coupled, physically and electrically, to the first member 110 at a coupling point 130 partway along the first length 132 of the first member 110. In a particular embodiment, the coupling point 130 is approximately halfway along the first length 132. Thus, for example, where the first length 132 is approximately of $\lambda/2$, the coupling point 130 is at a distance 134 of approximately $\lambda/4$ from the first end 111 of the first member 110 and at a distance 136 of approximately $\lambda/4$ from the second end 112 of the first member 110. However, the distance 136, the distance 134, or both, may be adjusted during design of the radiating element to tune radiative properties of the radiating element 100.

As further described below with reference to FIG. 4, the first member 110 and the second member 120 may be disposed within a non-conductive member. When the first member 110 and the second member 120 are disposed within a non-conductive member, the first member 110 may be formed as a via extending through and between several layers of a non-conductive material. The second member 120 may be formed as a trace disposed on one of the layers of non-conductive material.

In a particular embodiment, the second member 120 has a second length 138 that is about one-half of the first length 132, e.g., approximately $\lambda/4$. The second member 120 may extend at an angle away from the first member 110. For example, the second member 120 may be approximately perpendicularly to the first member 110. To illustrate, the first member 110 may extend along the z-axis 106 and the second member 120 may extend in a plane defined by the x-axis 102 and the y-axis 104. The coordinate labels are assigned merely as a convenience to provide a reference system to facilitate the description. Thus, for example, in some embodiments, the first member 110 and the second member 120 may not be perpendicular to one another. However, the coordinate labels are used with other drawings disclosed herein to assist with understanding possible configurations of the disclosed embodiments. Also for ease of reference, an angle $\theta$ 140 is defined as a declination from the z-axis 106 toward the plane defined by the x-axis 102 and the y-axis 104. An angle $\Phi$ 150 is defined as an angle in the plane defined by the x-axis 102 and the y-axis with $\Phi$ starting at 0° at the x-axis 102 and increasing through $\Phi$=90° at the y-axis 104 in a clockwise direction as viewed from the second end 112 of the first member 110 along the z-axis 106.

Figure 2:
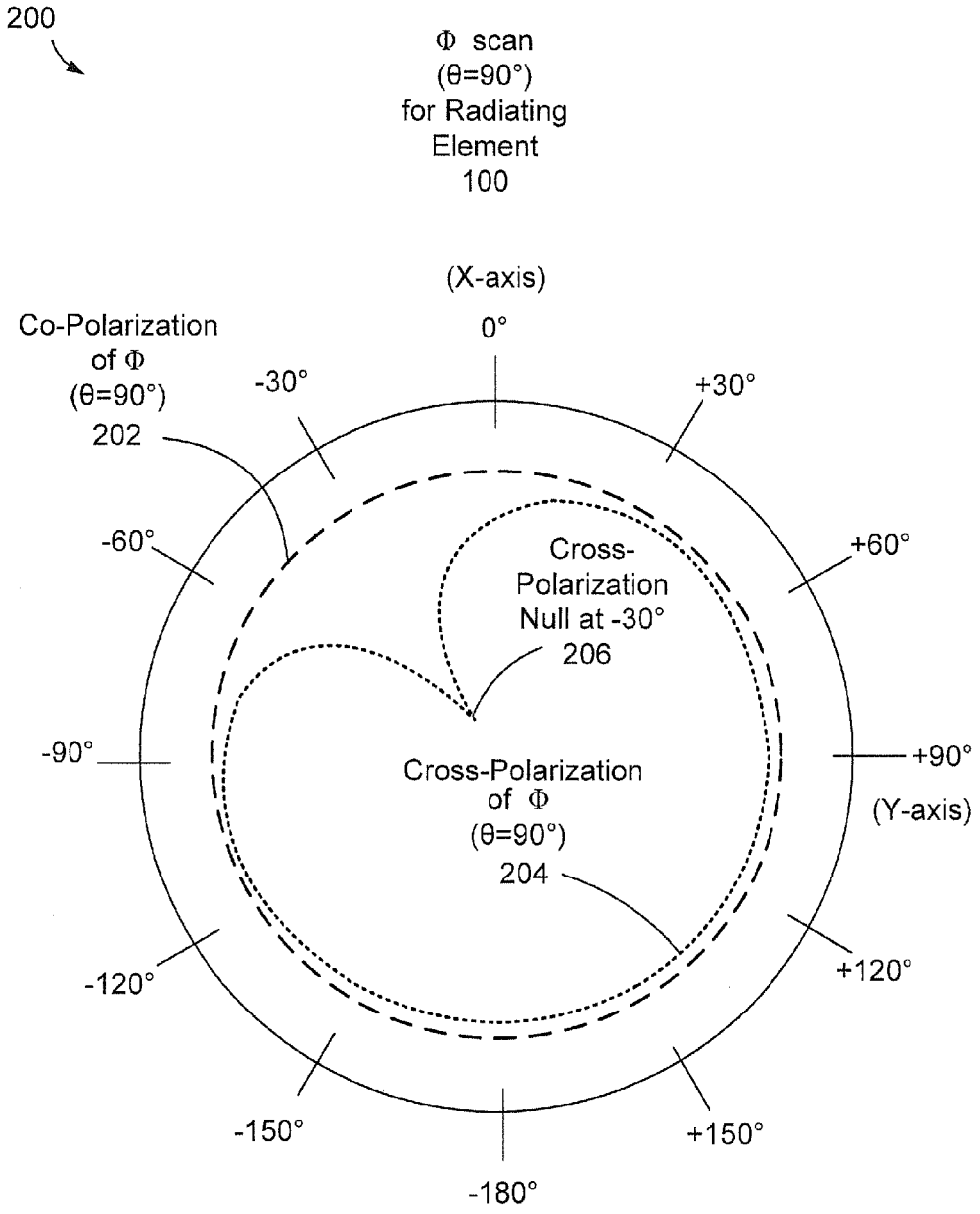
FIG. 2 is a graph of a $\Phi$ scan of the radiating element of FIG. 1 when the radiating element is used the presence of other radiating elements.

FIG. 2 is a graph 200 of a $\Phi$ scan of the radiating element of FIG. 1 when the radiating element is used the presence of other radiating elements. Specifically, the graph 200 shows the $\Phi$ scan radiation pattern at an angle of $\theta$=90°, e.g., in the plane defined by the x-axis 102 and the y-axis 104 of FIG. 1.

The graph 200 of the $\Phi$ scan shows a symmetrical co-polarization 202 radiation pattern. However, a cross-polarization 204 radiation pattern diminishes to a null 206 at an angular position of about $\Phi$=−30°. When the radiating element 100 is used in the presence of other radiating elements, constructive and destructive interaction of radiation patterns including nulls, such as the null 206, enable an array of radiating elements 100 to be used to radiate signals in a number of different patterns that may suit a number of different applications. The configuration of the radiating elements, the phase of a signal applied to each of the radiating elements, and possibly other factors may be configured to generate different radiation patterns.

For example, four radiating elements, such as the radiating element 100, may be used to form an antenna element. The radiating elements may be arranged in a square pattern. A first member, such as the first member 110 of FIG. 1, of each of the radiating members may be parallel with first members of the other radiating elements. That is, the first members of the radiating elements may extend generally in the same direction. A second member, such as the second member 120 of FIG. 1, of each of the radiating elements may be aligned toward a first member of an adjacent radiating element. In this arrangement, the second members are rotated 90 degrees from each other, and a null in the radiation pattern generated by each of the radiating members may be shifted by approximately 90 deg. relative to the adjacent radiating members. By adjusting the orientations of the second members, the arrangement of the radiating elements, the phase or magnitude of a signal provided to each radiating member, the position of each of the nulls may be controlled to cause an aggregate radiation pattern of the four radiating elements. In other examples, more than or fewer than four radiating elements may be used. Additionally, in other examples, the radiating elements may be used in other geometric configuration, such as a triangular configuration, a linear configuration, or another configuration.

Figure 3:
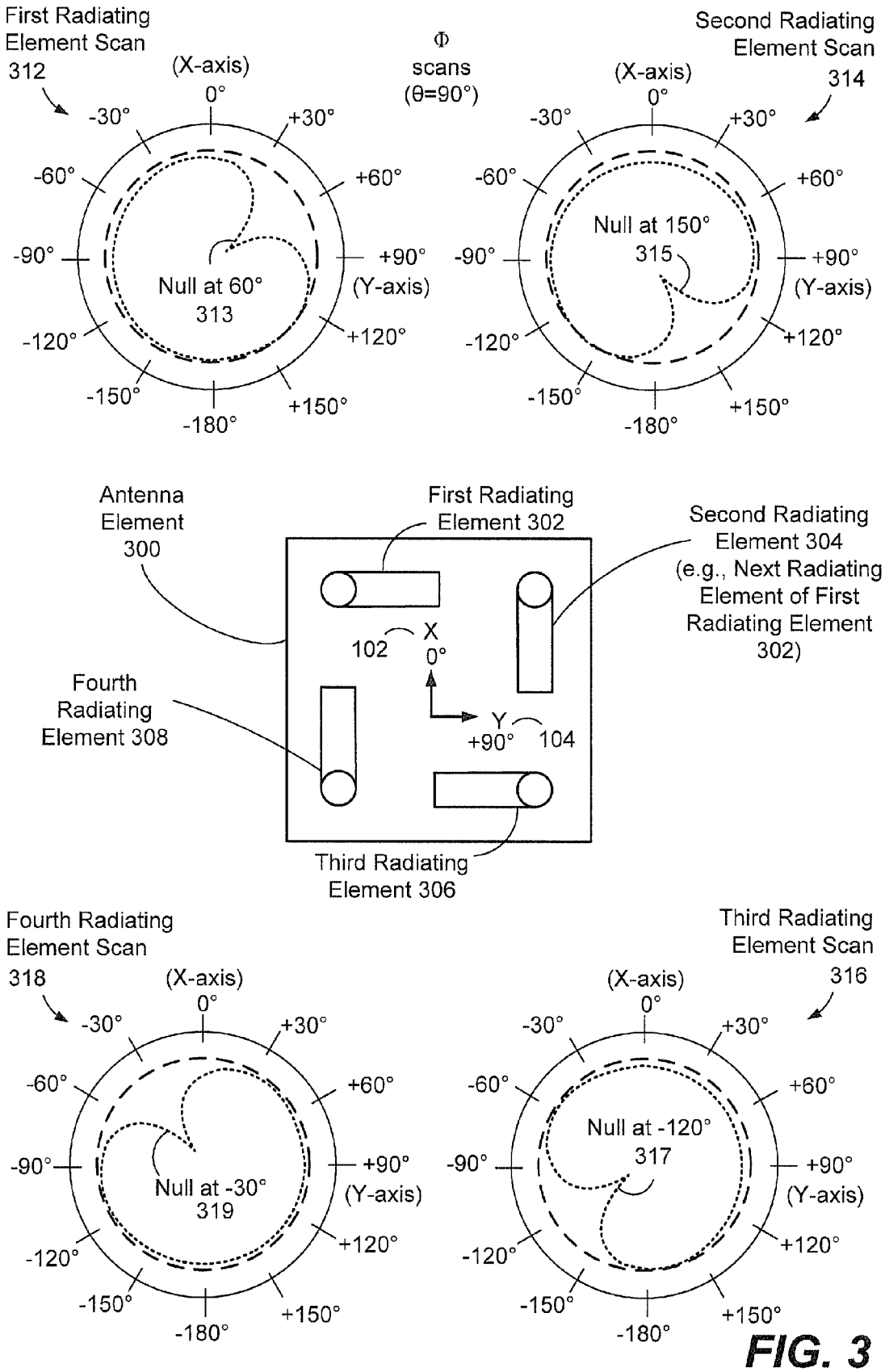
FIG. 3 is a diagram illustrating an antenna element including a plurality of the radiating elements and a $\Phi$ scan associated with each of the radiating elements.

FIG. 3 is a diagram illustrating an antenna element 300 including a plurality of the radiating elements 302, 304, 306, and 308 and Φ scans 312, 314, 316, and 318 associated with each of the radiating elements. The Φ scans 312, 314, 316, and 318 show radiation patterns at an angle of θ=90° of each of the radiating elements 302, 304, 306, and 308.

In the particular embodiment illustrated in FIG. 3, the radiating elements 302, 304, 306, and 308 are arranged, as viewed from above, in a square configuration with a first member, such as the first member 110 of FIG. 1, of each of the radiating elements 302, 304, 306, and 308 is positioned at a corner of a square. Additionally, as illustrated, a second member, such as the second member 120 of FIG. 1, of each of the radiating elements 302, 304, 306, and 308 is extends along a line that is aligned with an adjacent radiating element. For example, the second member of the first radiating element 302 extends along a line toward the second radiating element 304, and the second member of each of the other radiating elements 304, 306, and 308 is offset at an angle of Φ=90° relative to the second member of an adjacent radiating element.

The Φ scans 312, 314, 316, and 318 associated with each of the radiating elements 302, 304, 306, and 308 include nulls 313, 315, 317, and 319, respectively. In particular, each null is offset at an angle Φ=90° relative to the null of the adjacent radiating element 308, 302, 304, and 306. For example, the Φ scans 318 associated with the fourth radiating element 308 has a cross-polarization null 319 at about Φ=−30°; the Φ scans 312 associated with the first radiating element 302 has a cross-polarization null 313 at about Φ=+60°; the Φ scans 314 associated with the second radiating element 304 has a cross-polarization null 315 at about Φ=+150°; and the Φ scans 316 associated with the third radiating element 306 has a cross-polarization null 317 at about Φ=−120°.

Figure 4:
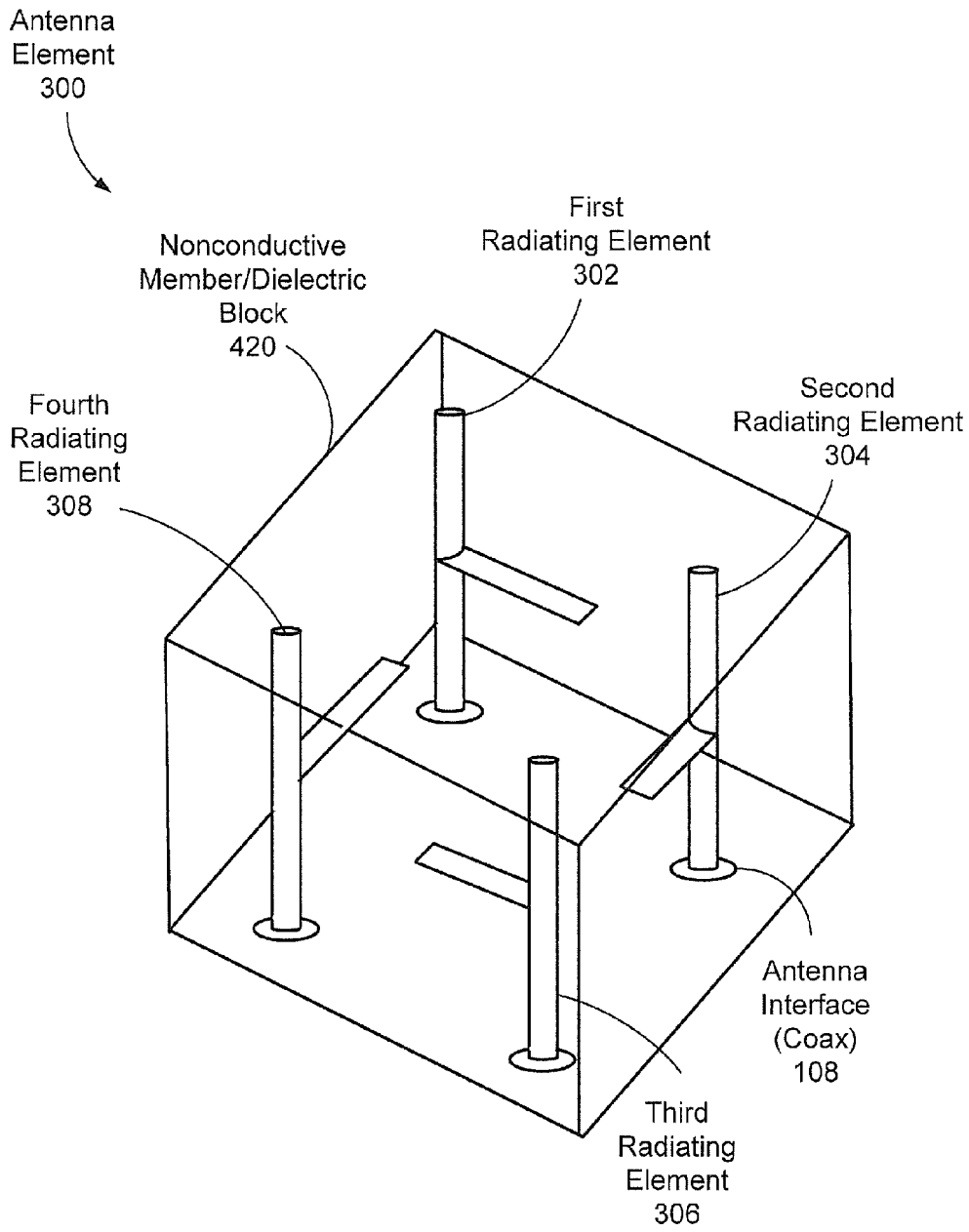
FIG. 4 is a perspective diagram illustrating a particular embodiment of an antenna element.

FIG. 4 a perspective diagram illustrating a particular embodiment of the antenna element 300 of FIG. 3. In FIG. 4, the plurality of radiating elements 302, 304, 306, and 308 are disposed in a non-conductive member 420, such as a dielectric block. As previously described with reference to FIG. 1, the radiating elements 302, 304, 306, and 308 may be formed as vias and traces formed through and on layers of material of the non-conductive member 420. Each of the radiating elements 302, 304, 306 and 308 may be coupled to a coax or other antenna interface 108.

Figure 5A:
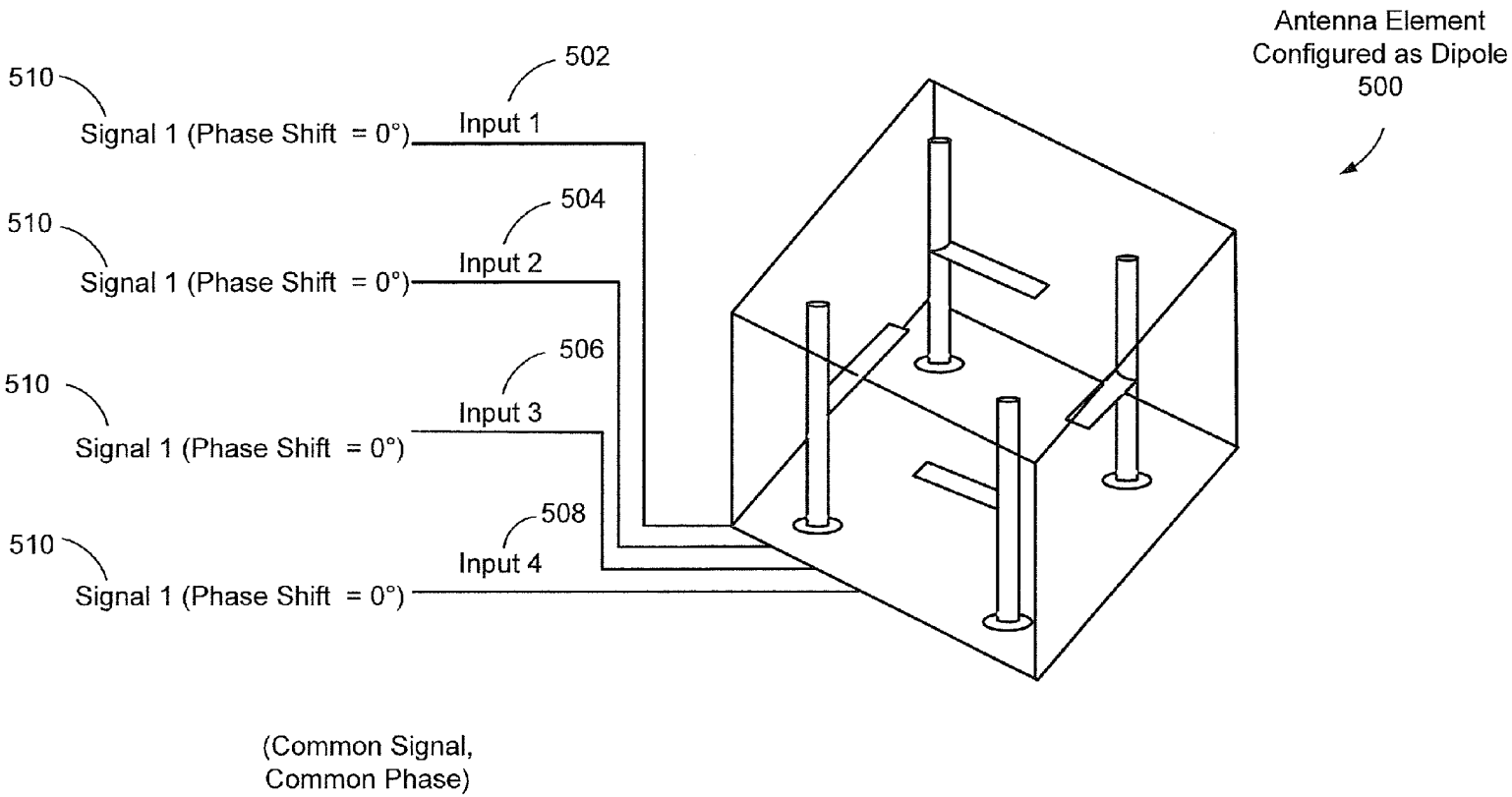
FIGS. 5A-5C show a perspective diagram illustrating a particular embodiment of an antenna element with first input signals and resulting $\Phi$ scan and $\theta$ scan radiation patterns.

FIG. 5A shows a perspective diagram illustrating a particular embodiment of an antenna element 500 with input signals. The antenna element 500 is configured as similar to that of the antenna element 300 of FIG. 3. The antenna element 500 includes a first input 502, a second input 504, a third input 506, and a fourth input 508. Each input 502, 504, 506, 508 is coupled to a corresponding one of the radiating elements via an antenna interface. The inputs are shown receiving a common signal at a common phase. That is, a first signal 510 is received at each of the inputs 502, 504, 506, and 508 and is supplied to the radiating elements.

Figure 5B:
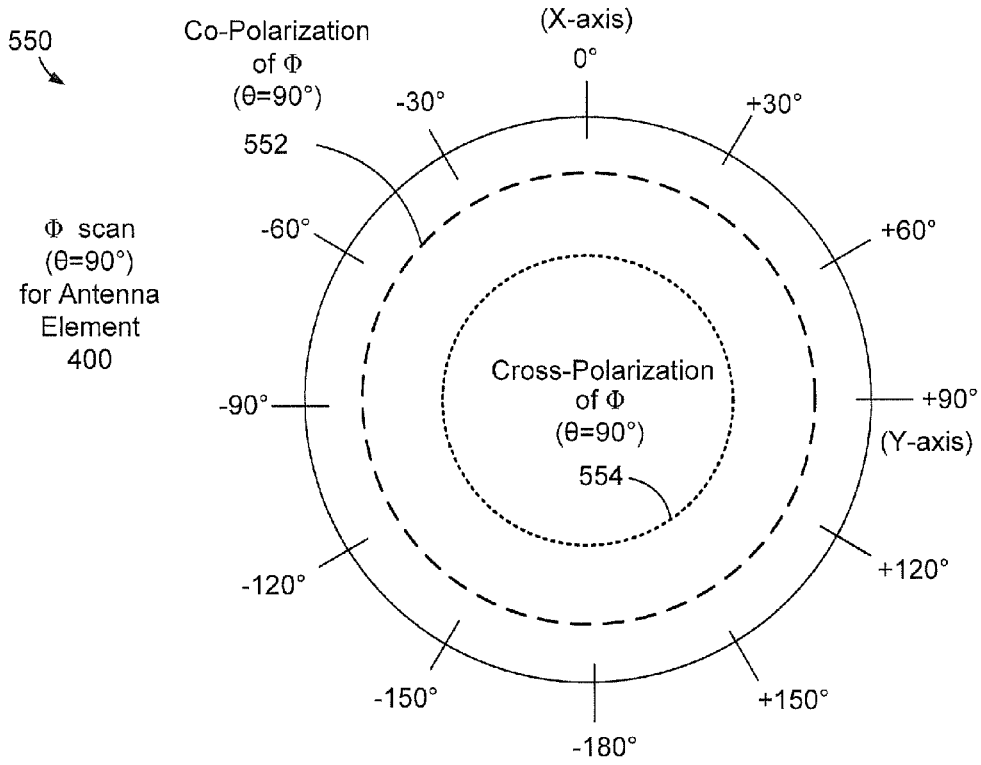

Referring to FIG. 5B, a Φ scan 550 at θ=90° corresponding to the antenna element 500 with the inputs illustrated in FIG. 5A (e.g., a common signal and common phase) shows a symmetrical co-polarization radiation pattern 552 and a symmetrical cross-polarization radiation pattern 554. The symmetrical co-polarization radiation pattern 552 and the symmetrical cross-polarization radiation pattern 554 of Φ scan 550 are similar to radiation patterns of a dipole antenna.

Figure 5C:
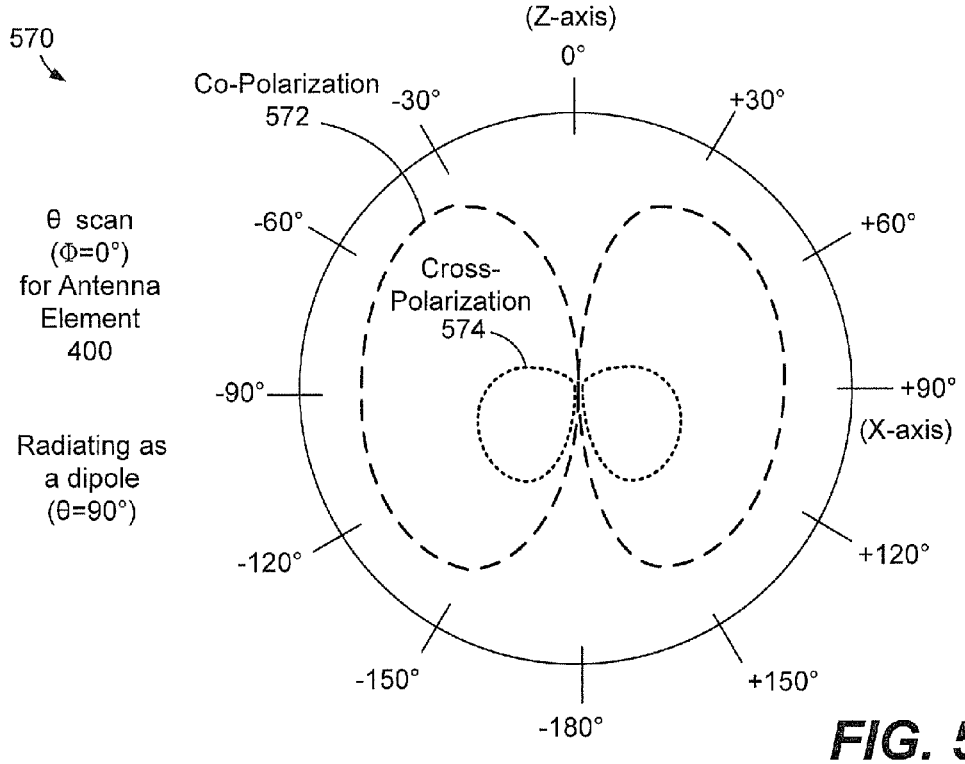

Referring to FIG. 5C, a θ scan 570 at Φ=0° corresponding to the antenna element 500 with the inputs illustrated in FIG. 5A (e.g., a common signal and common phase) shows a lobed co-polarization radiation pattern 572 and a lobed cross-polarization radiation pattern 574. The lobed co-polarization radiation pattern 572 and the lobed cross-polarization radiation pattern 574 of the θ scan 570 are also similar to radiation patterns of a dipole antenna. Thus, the antenna element 500, receiving the same signal at a common phase, such as the first signal 510 of FIG. 5A, radiates as though the antenna element 500 were a dipole antenna.

Figure 6A:
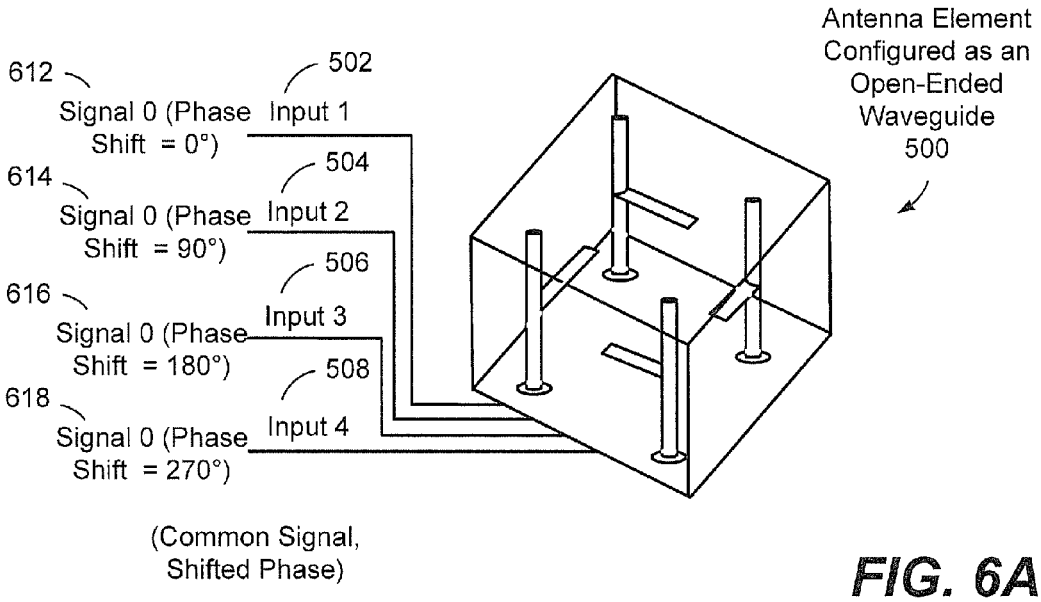
FIGS. 6A-6B include a perspective diagram illustrating a particular embodiment of an antenna element with second input signals and a resulting $\theta$ scan radiation pattern.

FIG. 6A shows a perspective diagram illustrating a particular embodiment of the antenna element 500 with second input signals. In the particular example illustrated, a signal received at each of the inputs 502, 504, 506, 508 is shifted relative to another of the inputs 502, 504, 506, 508. For example, a first signal 612 received at the first input 502 may have a phase designated 0°, for reference. A second signal 614 received at the second input 504 may have a phase of 90°. A third signal 616 received at the third input 506 may have a phase of 180°. A fourth signal 618 received at the fourth input 508 may have a phase of 270°. In an illustrative embodiment, the signals 612, 614, 616, and 618 may be the same signal but phase shifted. For example, the signal may be phase shifted using a coupler, by providing the signal from separate amplifiers coupled with phase shifters, or by other techniques.

Figure 6B:
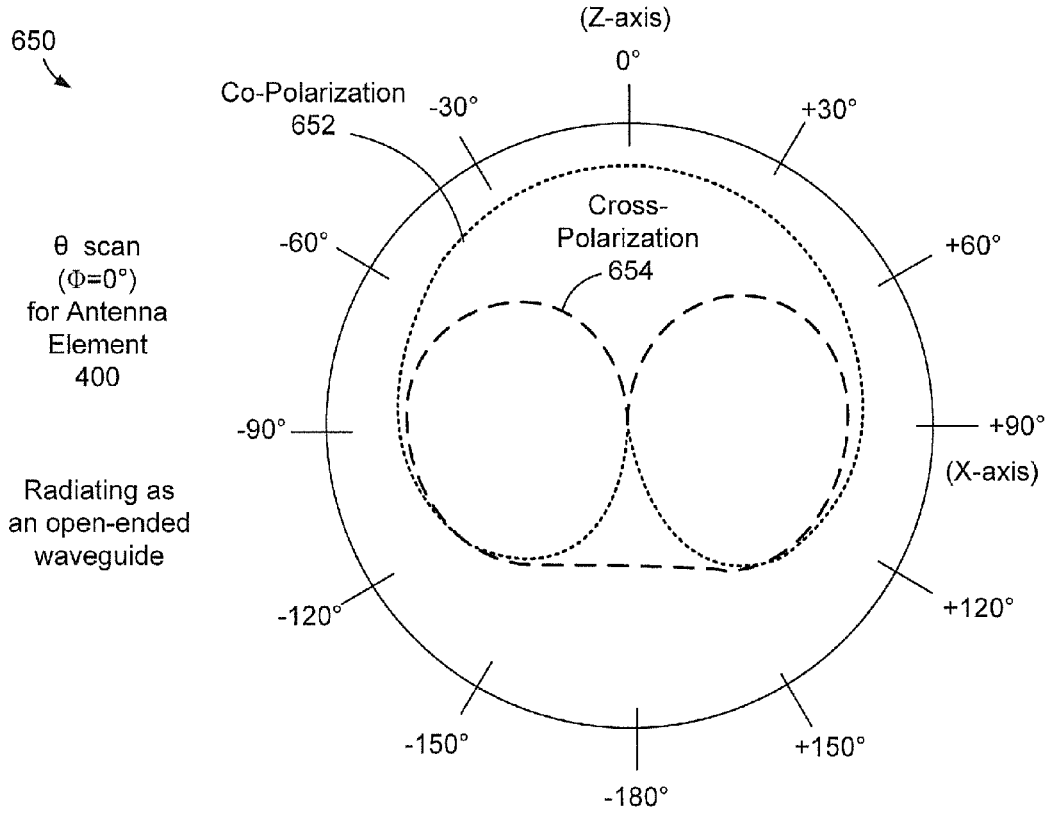

Referring to FIG. 6B, a θ scan 650 at Φ=0° resulting from applying the second input signals to the antenna element 500 is shown. The θ scan 650 shows an asymmetrical, nearly hemispherical co-polarization radiation pattern 652 and a lobed cross-polarization radiation pattern 654. The nearly hemispherical co-polarization radiation pattern 652 and the lobed cross-polarization radiation pattern 654 are similar to a radiation pattern of an open-ended waveguide. Thus, comparing FIGS. 5A-5C, 6A, and 6B, a single antenna element 500 may be used to model different types of antenna structures by adjusting a phase of a signal supplied to each of the radiating elements.

Figure 7A:
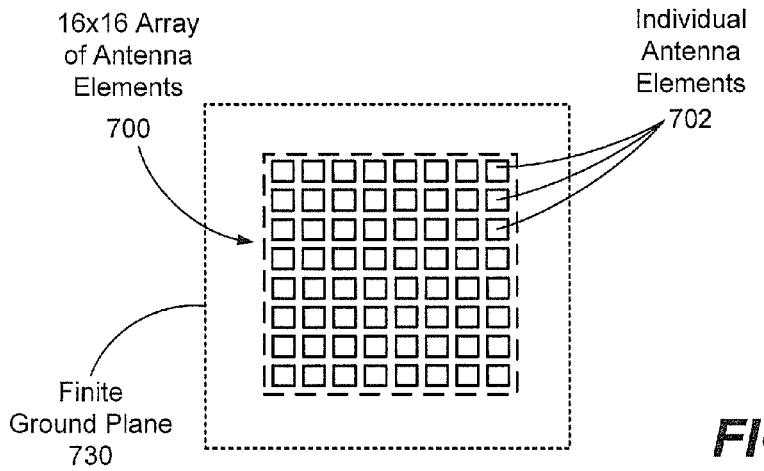
FIGS. 7A-7C include a diagram illustrating a particular embodiment of an array of antenna elements and associated $\theta$ scan radiation patterns when the array of antenna elements is configured to radiate as a dipole and as an open-ended waveguide, respectively.
Figure 7B:
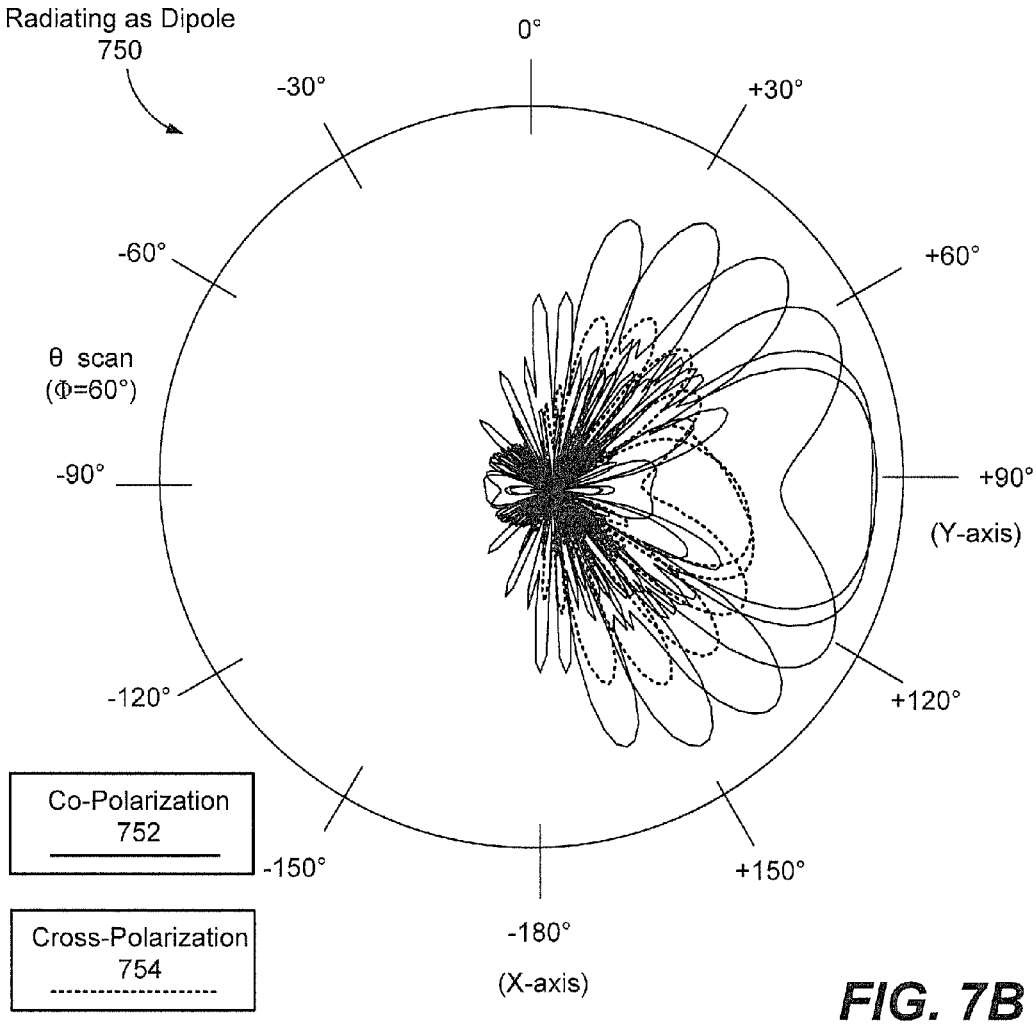

FIGS. 7A-7B show a diagram illustrating a particular embodiment of an array 700 of antenna elements 702 and an associated θ scan radiation pattern 750. The array 700 of antenna elements 702 includes a sixteen-by-sixteen (16×16) array of individual antenna elements 702. In a particular embodiment, each of the antenna elements 702 may include a plurality of radiating elements. For example, each of the antenna elements 702 may include the antenna element 500 of FIGS. 5A and 6A. The array 700 will function in the absence of a surrounding ground plane or when surrounded by a finite ground plane 730.

Figure 7C:
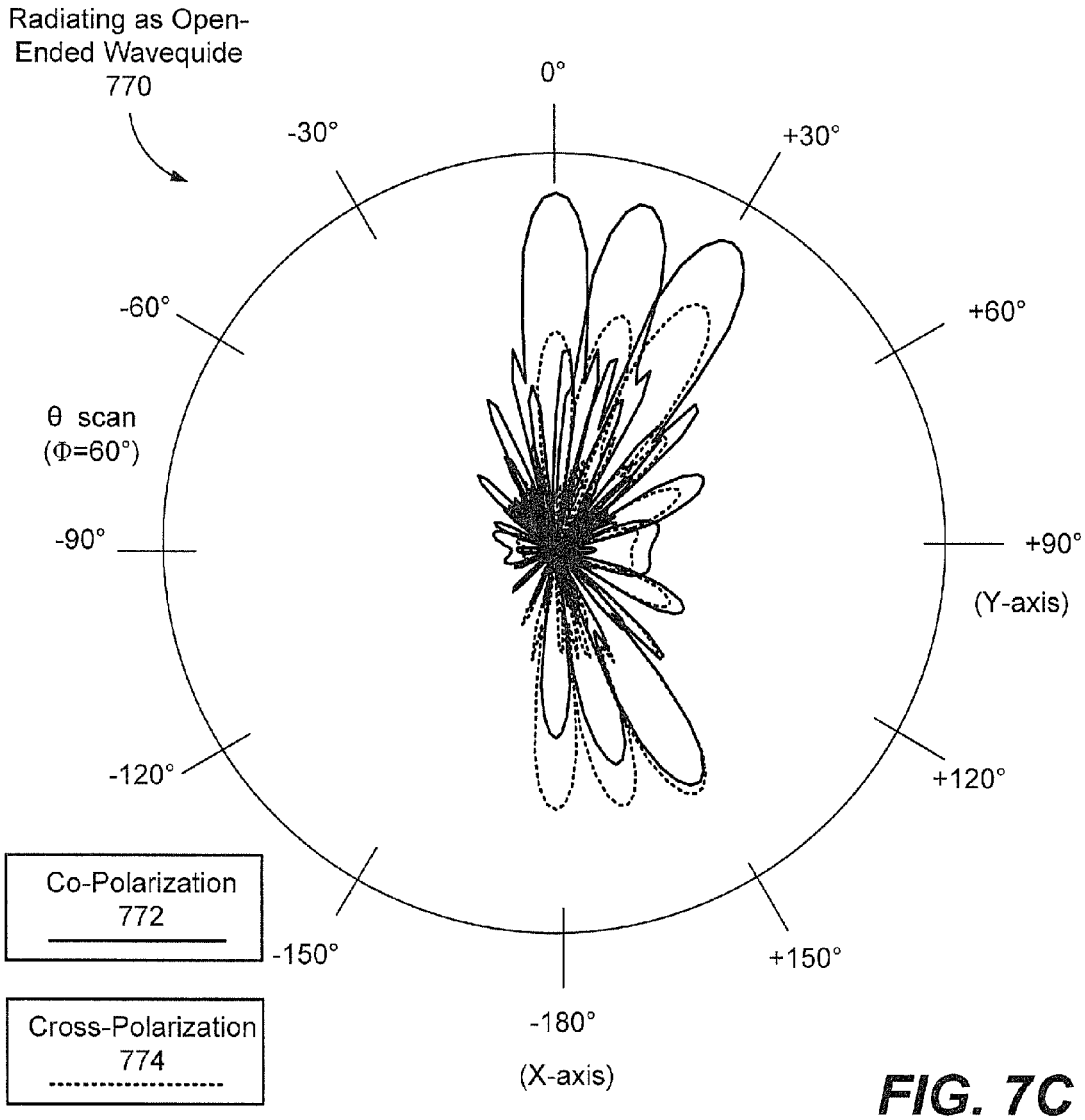

Referring to FIG. 7B, the θ scan 750 shows a highly directional co-polarization pattern 752 with a corresponding cross-polarization pattern 754 where the amplitude of the cross-polarization pattern 754 is much reduced with respect to the co-polarization pattern 752. The polarization patterns 752 and 754 may be achieved by modulating the phase of the signals provided to the radiating elements of the antenna elements 702 to configure the array 700 to operate as a dipole. Alternatively, referring to FIG. 7C, the θ scan 770 shows a highly directional co-polarization pattern 772 and a corresponding cross-polarization pattern 774 where the amplitude of the cross-polarization pattern 774 is much reduced with respect to the co-polarization pattern 772. The polarization patterns 772 and 774 may be achieved by modulating the phase of the signals provided to the radiating elements of the antenna elements 702 to configure the array to operate as an open-ended waveguide.

Figure 8:
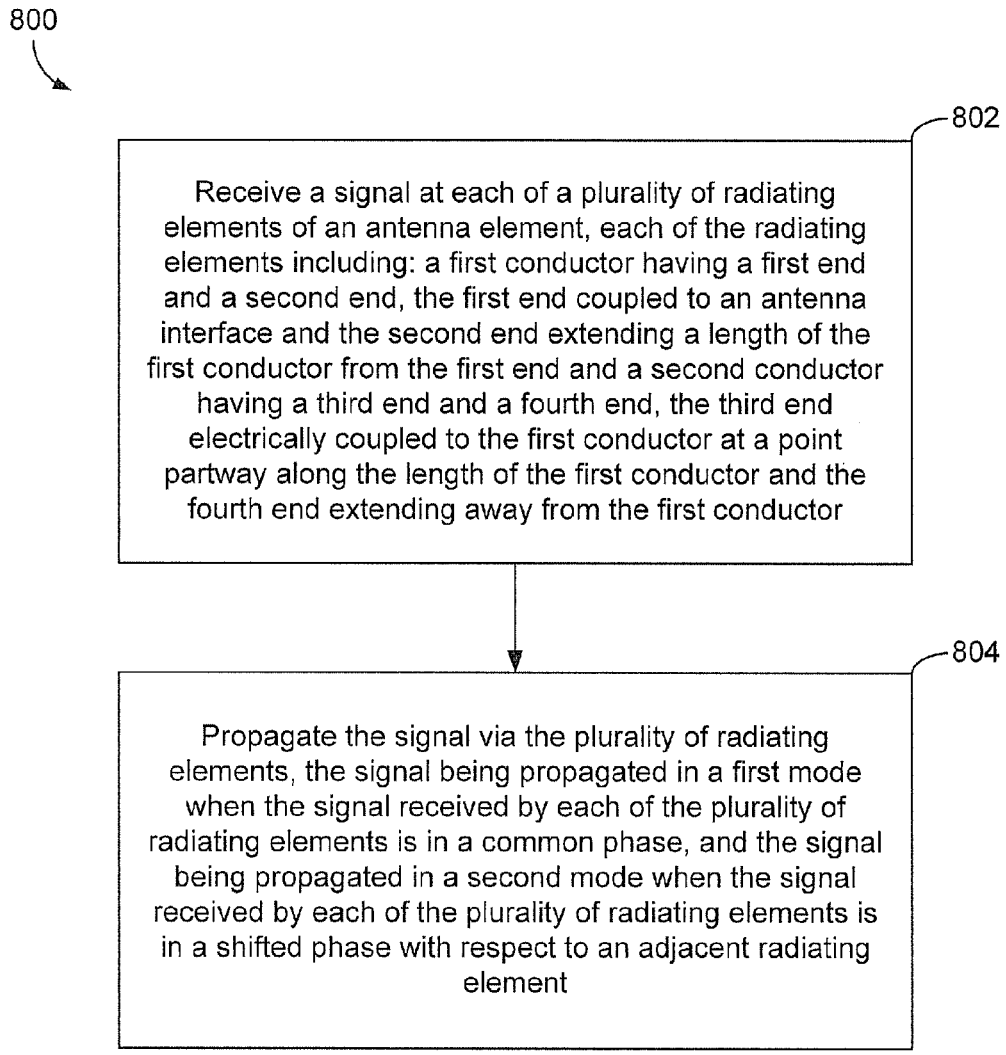
FIG. 8 is a flow diagram of a particular embodiment of a method of using an antenna element to generate a desired radiation pattern.

FIG. 8 is a flow diagram of a particular illustrative embodiment of a method 800 of using the antenna element, such as the antenna element 300 of FIG. 3 or the antenna element 500 of FIGS. 5A and 6A, to generate a desired radiation pattern. A signal is received at each of a plurality of radiating elements of the antenna element, at 802. As previously described with reference to FIGS. 1 and 3, each of the radiating elements may include a first conductor having a first end and a second end. The first end may be coupled to an antenna interface, and the second end may extend a length of the first conductor from the first end. Each of the radiating elements may also include a second conductor having a third end and a fourth end. The third end may be electrically coupled to the first conductor at a point partway along the length of the first conductor, and the fourth end may extend away from the first conductor.

The signal may be propagated via the plurality of radiating elements, at 804. For example, the signal may be propagated in a first mode when the signal received by each of the plurality of radiating elements is in a common phase. The signal may be propagated in a second mode when the signal received by each of the plurality of radiating elements is in a shifted phase with respect to an adjacent radiating element. For example, the antenna element 500 of FIGS. 5A and 6A may operate in a first mode, e.g., as a dipole antenna, when a signal is supplied to the radiating elements at a common phase. However, the antenna element 500 of FIGS. 5A and 6A may operate in a second mode, e.g., as an open-ended waveguide, when the signal supplied to the radiating elements is phase-shifted with respect to adjacent radiating elements.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. An apparatus, comprising:

a first antenna element comprising a plurality of radiating elements, each of the plurality of radiating elements comprising:

a first elongated member having a first end and a second end, the first end coupled to an antenna interface and the second end extending a length of the first elongated member from the first end; and a second elongated member having a third end and a fourth end, the third end electrically coupled to the first elongated member at a point partway along the length of the first elongated member and the fourth end extending away from the first elongated member;

wherein, when a first radiating element of the plurality of radiating elements is radiating in the presence of a second radiating element of the plurality of radiating elements, a null is generated in a radiation pattern of the first radiating element.

2. The apparatus of claim 1, wherein the length of the first elongated member is approximately one-half of a wavelength of a signal intended to be transmitted by the first antenna element.

3. The apparatus of claim 1, wherein the point partway along the length of the first elongated member is of a distance from the first end of approximately one-quarter of a wavelength of a signal intended to be transmitted by the first antenna element.

4. The apparatus of claim 1, wherein an angular position of the null in the radiation pattern is a function of a distance from the point partway along the length of the first elongated member to the second end.

5. The apparatus of claim 1, wherein the second end and the fourth end are free ends that are not electronically coupled to a conductive body.

6. The apparatus of claim 1, wherein, when each of the plurality of radiating elements is supplied at the first end with a signal of a same phase and a same magnitude, the first antenna element operates as a dipole antenna.

7. The apparatus of claim 6, wherein, when each of the plurality of radiating elements is supplied at the first end with a signal of a same magnitude and a different phase, the first antenna operates as an open-ended waveguide.

8. The apparatus of claim 7, wherein the first antenna element comprises:

four radiating elements, wherein the fourth end of each of the four radiating elements is aligned toward the first elongated member of an adjacent radiating element; and, the different phase of the signal supplied to each of the four radiating elements is shifted by ninety degrees as compared to the adjacent radiating element.

9. The apparatus of claim 1, wherein the third and fourth ends of the plurality of radiating elements are co-planar.

10. The apparatus of claim 1, wherein the plurality of radiating elements are at least partially disposed within in a non-conductive substrate.

11. The apparatus of claim 10, wherein the substrate includes at least two layers and wherein:

the first elongated member includes a via extending into the substrate perpendicularly across the at least two layers; and the second elongated member includes a trace extending substantially transversely from the first elongated member across one of the at least two layers.

12. The apparatus of claim 10, further comprising a ground plane, wherein the first ends of the first elongated members extend the length of the first elongated members above the ground plane.

13. The apparatus of claim 1, wherein the antenna interface includes a coax.

14. An apparatus, comprising:

an antenna element, including:

a non-conductive body; and a plurality of radiating elements supported within the non-conductive body, wherein each of the plurality of radiating elements includes:

a first conductor extending to a conductor end at a distance of approximately $\lambda/2$ above an antenna interface, where $\lambda$ is a wavelength of a signal intended to be transmitted via the antenna element; and a second conductor electrically coupled to the first conductor at a distance of approximately $\lambda/4$ above the antenna interface, wherein the second conductor extends substantially transversely from the first conductor, the plurality of radiating elements arranged such that the second conductor of each of the plurality of radiating elements extends generally toward an adjacent radiating element.

15. The apparatus of claim 14, wherein when the signal is supplied to each of the plurality of radiating elements at a same magnitude and in a common phase, the antenna element operates as a dipole antenna.

16. The apparatus of claim 14, wherein when the signal is supplied to each of the plurality of radiating elements at a same magnitude and in a shifted phase from the adjacent radiating element, the antenna element operates as an open-ended waveguide.

17. A method, comprising:

receiving a signal at each of a plurality of radiating elements of an antenna element, each of the radiating elements including:

a first conductor having a first end and a second end, the first end coupled to an antenna interface and the second end extending a length of the first conductor from the first end; and a second conductor having a third end and a fourth end, the third end electrically coupled to the first conductor at a point partway along the length of the first conductor and the fourth end extending away from the first conductor; and propagating the signal via the plurality of radiating elements, the signal being propagated in a first mode when the signal received by each of the plurality of radiating elements is at a same magnitude and in a common phase, and the signal being propagated in a second mode when the signal received by each of the plurality of radiating elements is in the same magnitude and at a shifted phase with respect to an adjacent radiating element.

18. The method of claim 17, wherein the plurality of radiating elements is arranged such that the first conductor of each of the plurality of radiating elements is substantially parallel with the first conductor of each of others of the plurality of radiating elements, and the second conductor of each of the plurality of radiating elements extend generally along a line that intersects of the plurality of the radiating elements.

19. The method of claim 17, wherein:

when the signal is supplied to each of the plurality of radiating elements in the common phase, the antenna element operates as a dipole antenna; and when the signal is supplied to each of the plurality of radiating elements in a shifted phase from the adjacent radiating element, the antenna element operates as an open-ended waveguide.

20. The method of claim 17, further comprising deploying a plurality of antenna elements and selectively modulating a phase of the signal presented to each of the plurality of radiating elements of each of the plurality of antenna elements to achieve a selected aggregate transmission pattern.

* * * * *